US007788957B2

(12) United States Patent
Okui et al.

(10) Patent No.: US 7,788,957 B2
(45) **Date of Patent: *Sep. 7, 2010**

(54) APPARATUS FOR PIPE END SIZING AND METHOD FOR PIPE END SIZING

(75) Inventors: Tatsuya Okui, Amagasaki (JP); Kouichi Kuroda, Takatsuki (JP); Masayoshi Akiyama, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 47 days.

This patent is subject to a terminal disclaimer.

(21) Appl. No.: 12/232,925

(22) Filed: Sep. 26, 2008

(65) Prior Publication Data

US 2009/0038367 A1 Feb. 12, 2009

Related U.S. Application Data

(63) Continuation of application No. PCT/JP2007/056679, filed on Mar. 28, 2007.

(30) Foreign Application Priority Data

Mar. 28, 2006 (JP) ..... 2006-088487

(51) Int. Cl.
*B21B 19/04* (2006.01)
*B21B 17/10* (2006.01)
*B21D 39/08* (2006.01)

(52) U.S. Cl. ..... 72/97; 72/209; 72/370.06

(58) Field of Classification Search ..... 72/97, 72/208, 209, 283, 370.1, 370.11, 370.03, 72/370.06, 370.07, 393
See application file for complete search history.

(56) References Cited

U.S. PATENT DOCUMENTS 4,161,112 A * 7/1979 Stump ..... 72/283
6,988,387 B2 * 1/2006 Nakaike et al. ..... 72/97

FOREIGN PATENT DOCUMENTS

| | | |
|---|---|---|
| JP | 62-024827 | 2/1987 |
| JP | 63-183738 | 7/1988 |
| JP | 09-029337 | 2/1997 |
| JP | 2001-113329 | 4/2001 |
| JP | 2004-243368 | 9/2004 |
| JP | 2004-273836 | 9/2004 |
| WO | 2006/033376 | 3/2006 |

* cited by examiner

*Primary Examiner*—Dana Ross
*Assistant Examiner*—Teresa M Bonk
(74) *Attorney, Agent, or Firm*—Clark & Brody

(57) ABSTRACT

An apparatus for sizing a pipe end comprising: a plug 3 for sizing the pipe end; a chuck 2 for clamping the pipe; and shifting means for shifting the position of the plug 3 and/the chuck 2, which are placed successively from the end of the pipe 2, and the plug 3 has a circular cross section, and is constituted by a taper portion 31 and a diameter equivalent portion 32 continuously formed from the tip of the plug in succession. The outer diameter of the taper portion 31 is gradually expanding from the tip toward the rear end while satisfying the following formulas (1) and (2). The chuck 2 is capable of changing clamping position of the pipe 1. This apparatus makes it possible to size the inner diameter of a pipe end with superior dimensional precision $$22 \leq LR/(D1 \times 0.01/2) \leq 115 \quad (1)$$

$$R2 \geq R1 \quad (2).$$

3 Claims, 6 Drawing Sheets

APPARATUS FOR PIPE END SIZING AND METHOD FOR PIPE END SIZING

This application is a continuation of International Patent Application No. PCT/JP2007/056679 filed Mar. 28, 2007. This PCT application was not in English as published under PCT Article 21(2).

The disclosure of Japan Patent Application No. 2006-088487 filed Mar. 28, 2006 including specification, drawings and claims is incorporated herein reference in its entirety.

TECHNICAL FIELD

The present invention relates to an apparatus used for sizing the inner diameter of the end of a pipe such as a seamless pipe or a welded pipe, and a sizing method thereof.

BACKGROUND ART

Normally, line pipes are welded and connected to one after another on the site; therefore, the pipe needs to be superior in dimensional precision in its pipe end, in particular, in its inner diameter. Moreover, normally, oil pipes are subjected to thread cutting processes in the end thereof, and these are joined to one another by tightening the ends. In this case also, the pipe needs to be superior in dimensional precision in its pipe end.

A known method for improving the inner diameter precision of a pipe end is that the pipe end is being expanded and sized by using an expanding apparatus.

FIG. 4 is a schematic drawing that explains a sizing method for the pipe end by using a conventional expanding apparatus. In the conventional method sizing for the pipe end, first, as shown in FIG. 4(*a*), with a pipe 1 to be sized being clamped by a chuck 2, a plug 5, connected to a cylinder 4, is moved in a direction indicated by an arrow in the Figure. Next, as shown in FIG. 4(*b*), the plug 5 is shoved to a predetermined position into the end of the pipe 1 so that the inner diameter of the pipe end is sized. Thereafter, as shown in FIG. 4(*c*), the plug 5 is moved in a direction indicated by another arrow in the Figure, and drawn from the pipe 1.

In this case, the plug to be used in the conventional expanding apparatus has a circular cross section, and is constituted by a taper portion and a diameter equivalent portion. The taper portion is a portion whose diameter gradually expands from the tip of the plug in the axial direction toward the rear end (from the left end to the right end in the Figure), and the diameter equivalent portion is a portion whose diameter is not varied. Here, the taper angle of the taper portion is kept constant.

Patent Document 1: JP2001-113329A

DISCLOSURE OF THE INVENTION

Problems To Be Solved By The Invention

The pipe obtained by the above-mentioned conventional pipe end sizing method tends to have variability in its inner diameter in a circumferential direction or an axis direction. The reason for this is explained below.

FIG. 5 is a schematic drawing that explains problems with the conventional pipe end sizing method. As shown in FIG. 5, the pipe 1 is expanded in its diameter by the plug 5 so that the inner diameter becomes from Din to D10. At this time, a phenomenon (hereinafter, referred to as "overshoot") occurs in that the inner diameter D10 of the pipe 1 becomes larger than the outer diameter D1 of the diameter equivalent portion 52.

If overshoot occurs, no force (repulsive force) is applied thereto from the diameter equivalent portion 52 since the inner face of the pipe 1 is not made in contact with the diameter equivalent portion 52. For this reason, variability occurs in the inner diameter of the pipe 1, failing to form a completely circular cross section. Moreover, the inner diameter of the pipe becomes irregular in the axial direction as well.

In an attempt to prevent variability in the inner diameter of the pipe, the overshoot is made to occur before the inner diameter of the pipe end has been expanded by the plug to the target inner diameter, and is then completed.

The inventers of the present invention proposed a plug as shown in FIGS. 1 to 3 in Japan Patent Application No. 2004-273836 in order to solve the above-mentioned problems.

A plug 3, shown in FIG. 1, has a circular cross section, and is constituted by a taper portion 31 and a diameter equivalent portion 3 that are continuously formed from the tip of the plug in succession, and the outer diameter of the taper portion 31 expands from the tip toward the rear end while satisfying the following formulas (1) and (2).

$$22 \leqq LR/(D1 \times 0.01/2) \leqq 115 \quad (1)$$

$$R2 \geqq R1 \quad (2)$$

Where the meanings of the respective symbols in the formulas are shown below:

D1: the outer diameter of the rear end of the taper portion, which also corresponds to the outer diameter (mm) of the diameter equivalent portion.

LR: the distance (mm) in the axial direction from the rear end of the taper portion to a position at which the outer diameter of the taper portion is represented by D1×0.99.

R1: the taper angle (°) at the rear end of the taper portion.

R2: the taper angle (°) at the position in which the outer diameter of the taper portion is represented by D1×0.99.

As shown in FIG. 2, upon sizing the inner diameter of the pipe 1 end by using this plug 3, first, as shown in FIG. 2(*a*), the plug 3 connected to the cylinder 4 is moved in a direction indicated by an arrow in the Figure, with the pipe 1 being clamped by a chuck 2. Moreover, as shown in FIG. 2(*b*), the plug 3 is shoved into the pipe 1 end to a predetermined position so as to size the inner diameter of the pipe end. Thereafter, as shown in FIG. 2(*c*), the plug 3 is moved in a direction indicated by another arrow in the Figure to be drawn from the pipe 1.

If the inner diameter is sized by diameter-expanding the pipe 1 by the use of this plug 3, as shown in FIG. 3, since the overshoot of the pipe 1, generated at the taper portion 31, is completed inside the taper portion 31, the inner face of the pipe 1 is made in contact with the diameter equivalent portion 32. For this reason, variability in the inner diameter is reduced smaller so that the inner diameter of the pipe 1 end can be sized, with its true circle state being maintained.

By using this plug, the inner face of the pipe is made in contact not only with the taper portion, but also with the diameter equivalent portion so that the contact area increases, resulting in an increase in a load to be used for sizing the inner diameter of the pipe end. Consequently, the clamping force by the chuck 2 needs to be increased. In the case of a pipe with a certain measure of thickness, no adverse effects are given to the shape or the like of the pipe, even when the clamping force increases; however, in the case of a thin material that is insufficient in rigidity (with the ratio (t/D) of the thickness t and the outer diameter D of the pipe being 0.04 or less), the pipe is deformed by the clamping force. The resulting deformation causes degradation in the dimensional precision in the inner diameter of the end (that is, the end to be diameter-expanded) of the pipe. Therefore, the clamping position needs to be appropriately set depending on the dimension of the pipe.

The present invention has been devised from these points of view, and its objective is to provide a pipe end sizing apparatus and a pipe end sizing method that produces a pipe that is superior in the dimensional precision in the inner diameter of the pipe end.

Means For Solving the Problems

The present invention relates to a pipe end sizing apparatus shown in the following (A) and a pipe end sizing method shown in the following (B) and (C).

(A) An apparatus for sizing a pipe end comprising:

a plug for sizing the pipe end;

a chuck for clamping the pipe; and shifting means for shifting the position of the plug and/or the chuck, characterized by the plug has a circular cross section, and is constituted by a taper portion and a diameter equivalent portion continuously formed from the tip of the plug in succession, an outer diameter of the taper portion gradually expands from the tip toward the rear end while satisfying the following formulas (1) and (2) the chuck is capable of changing a clamping position of the pipe:

$$22 \leqq LR/(D1 \times 0.01/2) \leqq 115 \quad (1)$$

$$R2 \geqq R1 \quad (2)$$

where the meanings of the respective symbols in the formulas are shown below:

D1: the outer diameter of the rear end of the taper portion, which also corresponds to the outer diameter (mm) of the diameter equivalent portion.

LR: the distance (mm) in the axial direction from the rear end of the taper portion to a position at which the outer diameter of the taper portion is represented by D1×0.99.

R1: the taper angle (°) at the rear end of the taper portion.

R2: the taper angle (°) at the position in which the outer diameter of the taper portion is represented by D1×0.99.

(B) A method for sizing a pipe end by using a plug, characterized by:

using the plug having a circular cross section and being constituted by a taper portion and a diameter equivalent portion continuously formed from a tip of the plug in succession;

an outer diameter of the taper portion gradually expands from the tip toward a rear end while satisfying the following formulas (1) and (2); and setting the clamping position of the pipe by the chuck in accordance with a value of a ratio (t/D) of the thickness t and the outer diameter D of the pipe:

$$22 \leqq LR/(D1 \times 0.01/2) \leqq 115 \quad (1)$$

$$R2 \geqq R1 \quad (2)$$

where the meanings of the respective symbols in the formulas are shown below:

D1: the outer diameter of the rear end of the taper portion, which also corresponds to the outer diameter (mm) of the diameter equivalent portion.

LR: the distance (mm) in the axial direction from the rear end of the taper portion to a position at which the outer diameter of the taper portion is represented by D1×0.99.

R1: the taper angle (°) at the rear end of the taper portion.

R2: the taper angle (°) at the position in which the outer diameter of the taper portion is represented by D1×0.99.

(C) The method for sizing the pipe end according to (B) characterized by, the pipe is clamped at a position in which the following formula is satisfied, when the ratio (t/D) of the thickness t and the outer diameter D of the pipe is 0.04 or less:

$$L/D > -21.8 \times (t/D) + 1.7 \quad (3)$$

where the meanings of the respective symbols in the formula are shown below:

t: Thickness of element pipe (mm)

D: Outer diameter of element pipe (mm)

L: Distance from the pipe end of the pipe on the side from which the plug is inserted to the clamped position by the chuck (mm)

Effect of the Invention

In accordance with the present invention, the inner diameter of the pipe end can be sized with superior dimensional precision.

BEST MODE FOR CARRYING OUT THE INVENTION

As shown in FIG. 2, a pipe end sizing apparatus in accordance with the present invention is provided with, for example, a plug 3 inserted into the pipe 1 end, a chuck 2 used for clamping a pipe and a shifting means (not shown) for shifting the plug 3 and/or the chuck 2. As shown in FIG. 1, the plug 3 to be used in the pipe end sizing apparatus of the present invention has a circular cross section, and is constituted by a taper portion 31 and a diameter equivalent portion 32 continuously formed from the tip of the plug in succession, with the outer diameter of the taper portion 31 gradually expanding from the tip toward the rear end while satisfying the following formulas (1) and (2).

$$22 \leqq LR/(D1 \times 0.01/2) \leqq 115 \quad (1)$$

$$R2 \geqq R1 \quad (2)$$

Where the meanings of the respective symbols in the formulas are shown below:

D1: the outer diameter of the rear end of the taper portion, which also corresponds to the outer diameter (mm) of the diameter equivalent portion.

LR: the distance (mm) in the axial direction from the rear end of the taper portion to a position at which the outer diameter of the taper portion is represented by D1×0.99.

R1: the taper angle (°) at the rear end of the taper portion.

R2: the taper angle (°) at the position in which the outer diameter of the taper portion is represented by D1×0.99.

As shown in FIG. 3, in the case when the plug 3 is inserted into the pipe 1, since the overshoot of the pipe 1 occurred in the taper portion 31 is completed within the taper portion 31, the inner face of the pipe 1 is made in contact with the diameter equivalent portion 32. That is, since the taper angle R2 at the position in which the outer diameter of the taper portion 31 is represented by D1×0.99 (hereinafter, referred to as "D2") is greater than the taper angle R1 at the rear end of the taper portion 31, and since the distance LR in the axial direction from the rear end of the taper portion to the position at which the outer diameter is represented by D2 satisfies the above-mentioned formula (1), the pipe 1 is hardly subjected to a bending process on the rear end side from the position at which the outer diameter of the taper portion 31 is represented by D2.

For this reason, the overshoot occurs on the rear end side from the position at which the outer diameter of the taper portion 31 is represented by D2, with the result that it is completed before reaching the diameter equivalent portion 32. Thus, the pipe 1 end can be sized in its inner diameter, with variations in the inner diameter being kept small and with its true circle state being maintained.

As shown in FIG. 2(*a*), the apparatus for the pipe end sizing in accordance with the present invention is characterized in that the position in which the pipe 1 is clamped by the chuck 2, that is, the distance from the pipe end of the pipe 1 on the side from which the plug 3 is inserted to the clamped position by the chuck 2 can be altered. Here, the clamped position refers to the portion of the chuck closest to the pipe end.

When a core deviation occurs between the axis centers of the element pipe and the plug, it is not possible to carry out a sizing process on the inner diameter with high precision, and a problem sometimes also arises in that the material is buckled. In order to prevent the core deviation, it is preferable to carry out the clamping process at such a position as close to the pipe end as possible. However, in the case of a thin material, that is, more specifically, in the case of t/D≦0.04 (t: wall thickness, D: outer diameter), the clamping tends to cause a deformation; consequently, when a portion close to the pipe end is clamped, the pipe end is also deformed, with the result that the inner diameter is not sized with high precision in some cases. In contrast, in the case of the thin material, since the rigidity is poor, even when a portion far apart from the pipe end is clamped, the centering effect is exerted, hardly resulting in the core deviation.

From these points of view, the pipe end sizing apparatus of the present invention allows the clamping position of the pipe to be altered so that, when a thick-wall material is sized, a portion closer to the pipe end is clamped, while, when a thin-wall material is sized, a portion far apart from the pipe end is clamped. Moreover, in the pipe end sizing method in accordance with the present invention, the clamping position of the pipe by the chuck is set in accordance with the value of a ratio (t/D) of the thickness t and the outer diameter D of the pipe.

For example, if the value of a ratio (t/D) of the thickness t and the outer diameter D of the pipe (element pipe) is 0.04 or less, the pipe is preferably clamped by the chuck at a position that satisfies the following formula (3). The reason for having to provide such a condition as to satisfy the following formula (3) with respect to the clamping position of the pipe by the chuck will be explained in Examples.

$$L/D > -21.8 \times (t/D) + 1.7 \quad (3)$$

Where, the meanings of the respective symbols in the formula are shown below:

t: Thickness of element pipe (mm)

D: Outer diameter of element pipe (mm)

L: Distance from the pipe end the plug is inserted to the clamping position by the chuck (mm)

EMBODIMENTS

In order to confirm the effect of the present invention, a plug, as shown in FIG. 1, was inserted into the end of a seamless steel pipe made of carbon steel so that the pipe was diameter-expanded and the elliptic rate of the inner diameter of the pipe after having been diameter-expanded was examined. Table 1 shows the outer diameter and the wall thickness of each of pipes subjected to the experiments, as well as the shapes of the plugs, clamped positions and the elliptic rate of the inner diameter.

With respect to the elliptic rate of the inner diameter, the inner face shape of the pipe after having been diameter-expanded was measured by a shape measuring apparatus, and it was calculated based upon the following equation. In the following equation, "dmax" represents the maximum inner diameter, "dmin" represents the minimum inner diameter and "dave" represents the average inner diameter, respectively.

Elliptic rate of inner diameter (%)=(dmax−dmin)/dave×100

[Table 1]

TABLE 1

| | | No. | | | | | | |
|---|---|---|---|---|---|---|---|---|
| | | 1 | 2 | 3 | 4 | 5 | 6 | 7 |
| Pipe shape | Outer diameter D(mm) | 323.9 | 323.9 | 323.9 | 323.9 | 323.9 | 339.7 | 323.9 |
| | Thicknes t(mm) | 6.35 | 6.35 | 6.35 | 6.35 | 6.35 | 14.00 | 20.00 |
| | t/D | 0.020 | 0.020 | 0.020 | 0.020 | 0.020 | 0.041 | 0.062 |
| Plug shape | D1(mm) | 315.9 | 315.9 | 315.9 | 315.9 | 315.9 | 315.9 | 287.9 |
| | R1(°) | 1.1 | 1.1 | 1.1 | 1.1 | 1.1 | 1.1 | 0.7 |
| | D2(mm) | 313.2 | 313.2 | 313.2 | 313.2 | 313.2 | 313.2 | 286.3 |
| | R2(°) | 5.9 | 5.9 | 5.9 | 5.9 | 5.9 | 5.9 | 5.0 |
| | LR(mm) | 70.0 | 70.0 | 70.0 | 70.0 | 70.0 | 70.0 | 65.0 |
| | LB(mm) | 10.0 | 10.0 | 10.0 | 10.0 | 10.0 | 10.0 | 10.0 |
| Clamping position | DistanceL(mm) | 180 | 180 | 290 | 504 | 504 | 290 | 290 |
| | L/D | 0.56 | 0.56 | 0.90 | 1.56 | 1.56 | 0.85 | 0.90 |
| Elliptic rate of inner diameter (%) | | 0.53 | 0.48 | 0.42 | 0.22 | 0.23 | 0.29 | 0.30 |

With respect to the results shown in Table 1, the relationship between the elliptic rate of inner diameter and L/D (L: distance from the pipe end of the pipe on the side from which a plug is inserted to the clamped position by the chuck, D: outer diameter of element pipe) is shown in FIG. 6, and the relationship between L/D with the elliptic rate of inner diameter being set to 0.3% and t/D (t: wall thickness of the element pipe, D: outer diameter of the element pipe) is shown in FIG. 7.

In FIG. 7, in the case of t/D=0.020 (○ in the Figure) in FIG. 6, L/D at an intersection between an approximation straight line and the straight line indicating the elliptic rate of inner diameter=0.3% was selected, and in the case of t/D=0.41 (● in the Figure) and t/D=0.062 (□ in the Figure), L/D of the respectively plotted values was selected.

As shown in Table 1 and FIG. 6, in the case of a thick pipe in which t/D exceeds 0.04, the elliptic rate of inner diameter is maintained at 0.3, which is a low value, even when L/D is near 0.9; however, in the case of a thin pipe in which t/D is 0.020, the elliptic rate of inner diameter is varied depending on the value of L/D. This indicates that depending on the value of t/D, the distance from the pipe end which a plug is inserted to the clamped position by the chuck needs to be adjusted.

Moreover, as shown in Table 1 and FIG. 7, in the case when t/D of the element pipe is 0.04 or less, in order to set L/D so that the elliptic rate of inner diameter becomes 0.3%, L/D should be located within the range that satisfy the following formula (3).

$$L/D > -21.8 \times (t/D) + 1.7 \quad (3)$$

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

INDUSTRIAL APPLICABILITY

In accordance with the present invention, the inner diameter of a pipe end can be sized with superior dimensional precision; therefore, the present invention is effectively applied to a sizing process for joint portions of line pipes, oil pipes and the like.

DESCRIPTION OF THE REFERENCE NUMERALS

Figure 1:
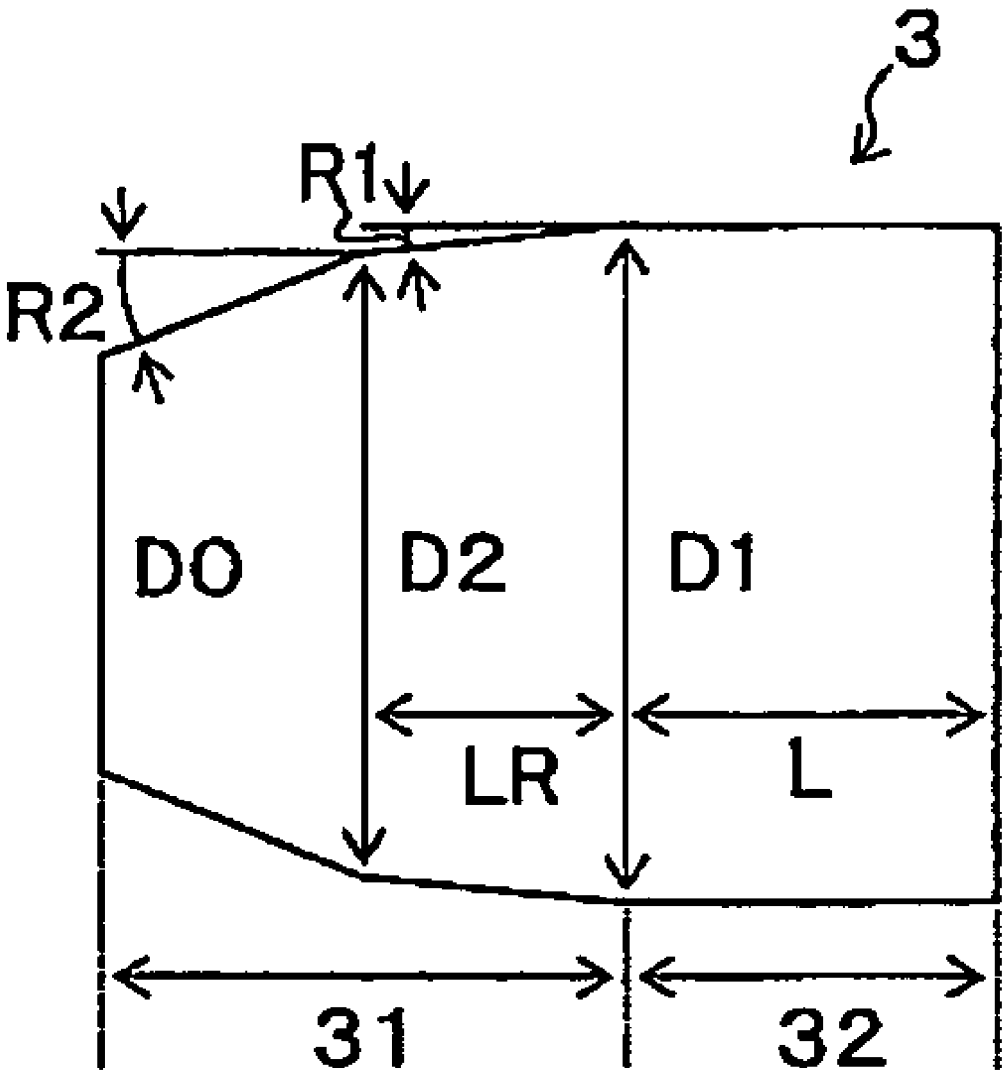
FIG. 1 is a schematic drawing that exemplifies a plug to be used in the present invention.
Figure 2:
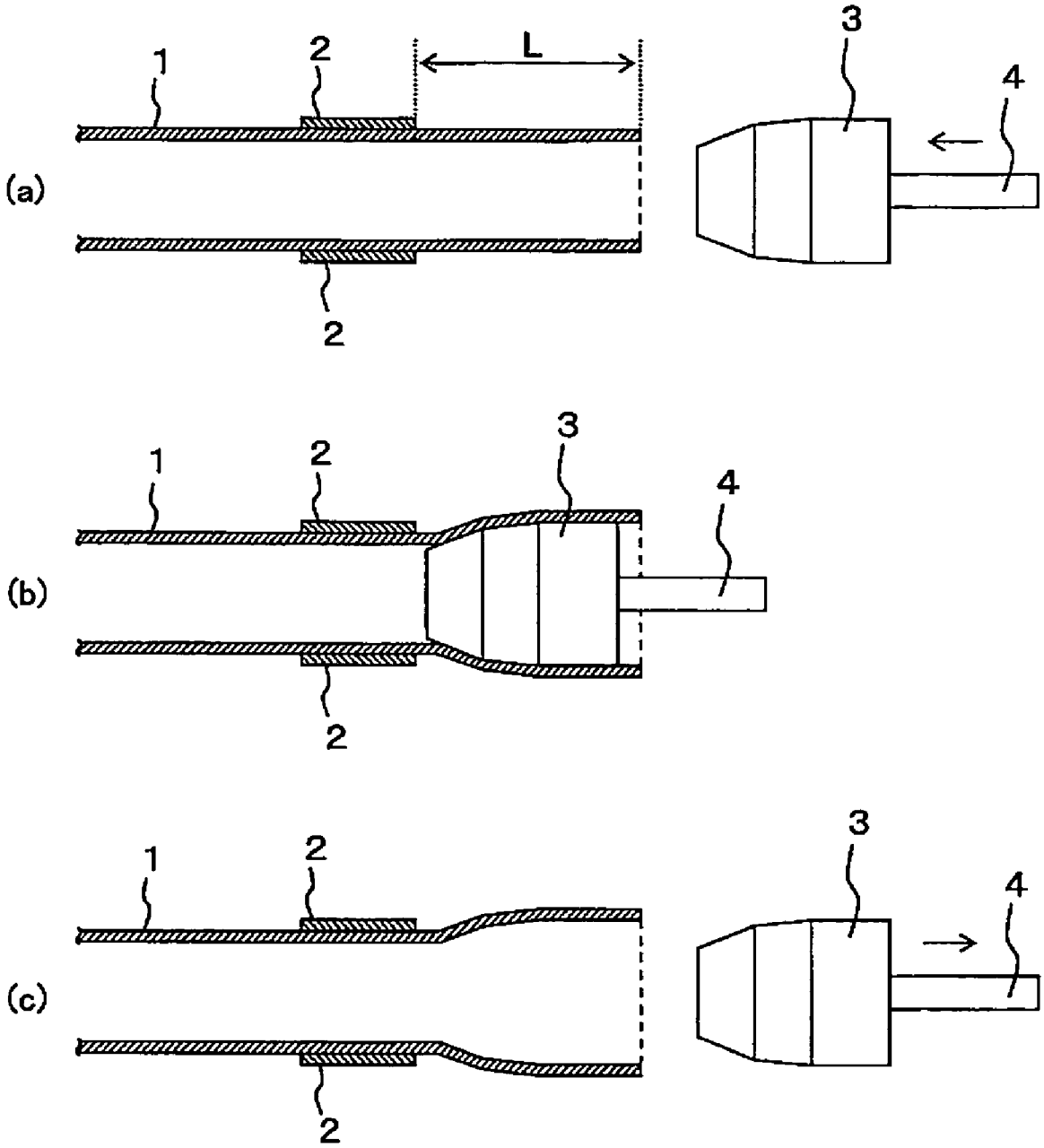
FIG. 2 is a schematic drawing that explains a pipe end sizing method in accordance with the present invention.
Figure 3:
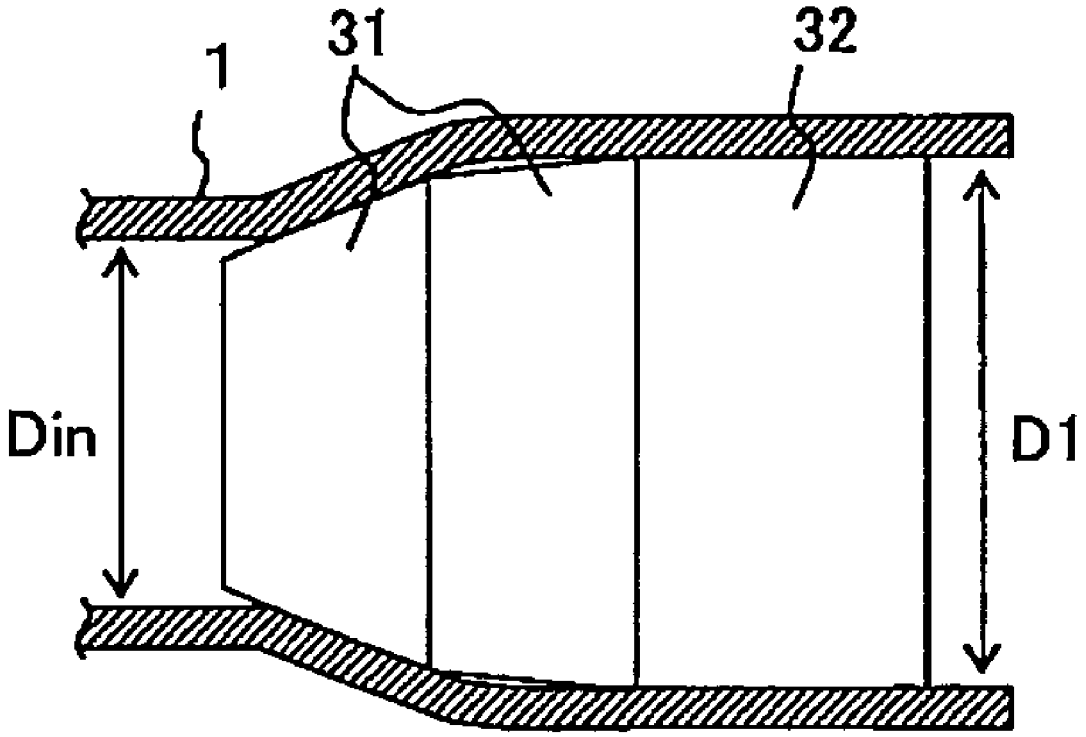
FIG. 3 is a schematic drawing that explains a pipe-diameter expanded state in accordance with the pipe end sizing method of the present invention.
Figure 4:
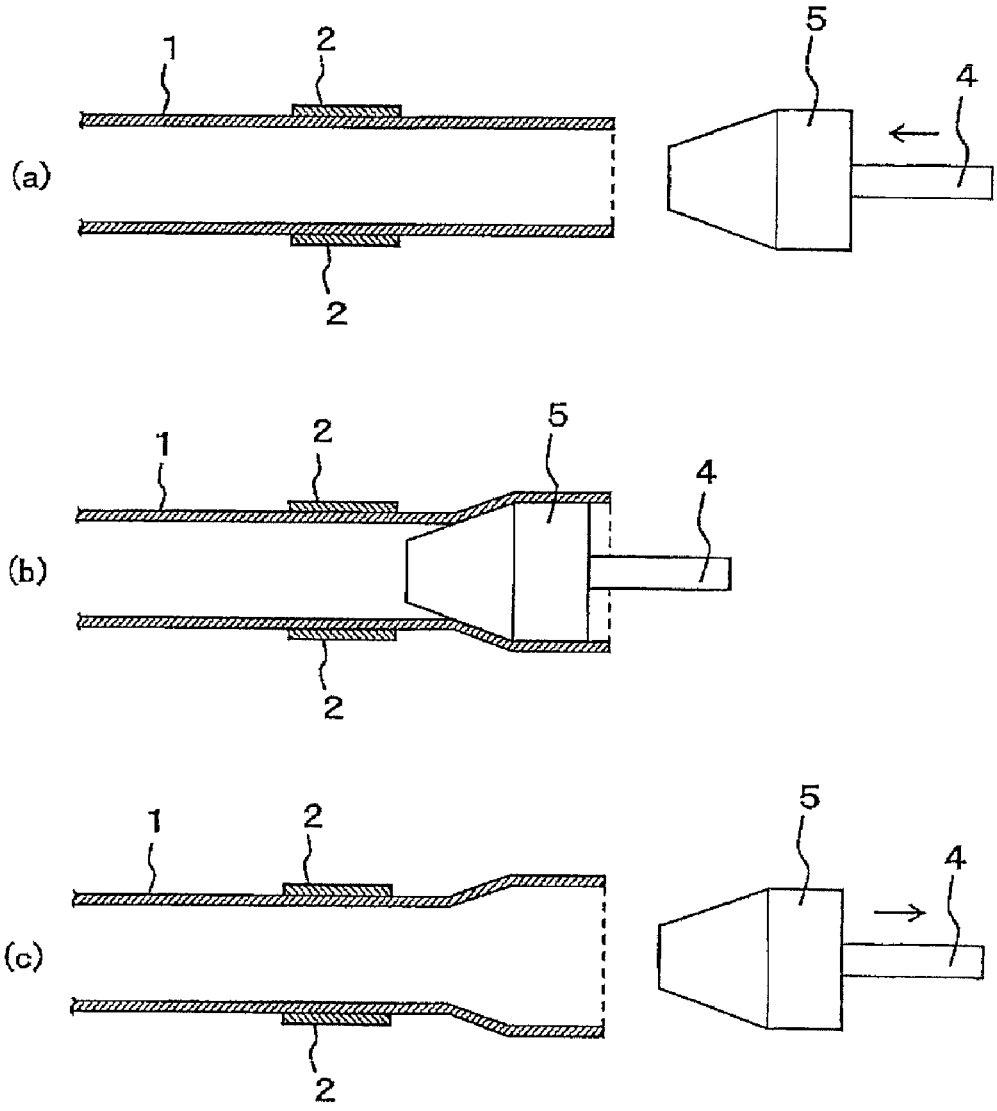
Figure 4 PRIOR ART
FIG. 4 is a schematic drawing that explains a sizing method for a pipe end by the use of a conventional expanding apparatus.
Figure 5:
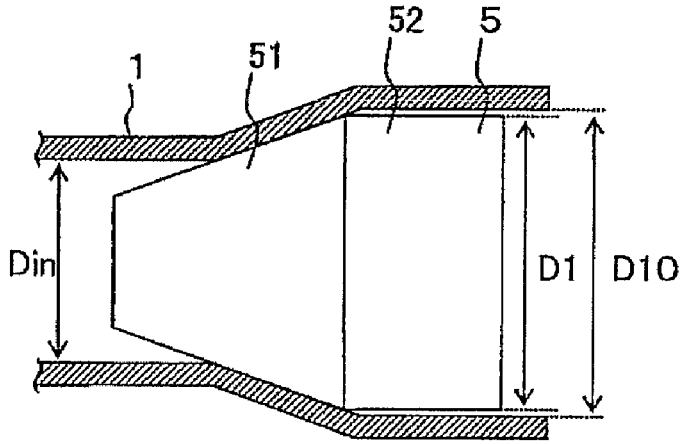
Figure 5 PRIOR ART
FIG. 5 is a schematic drawing that explains problems with the conventional pipe end sizing method.
Figure 6:
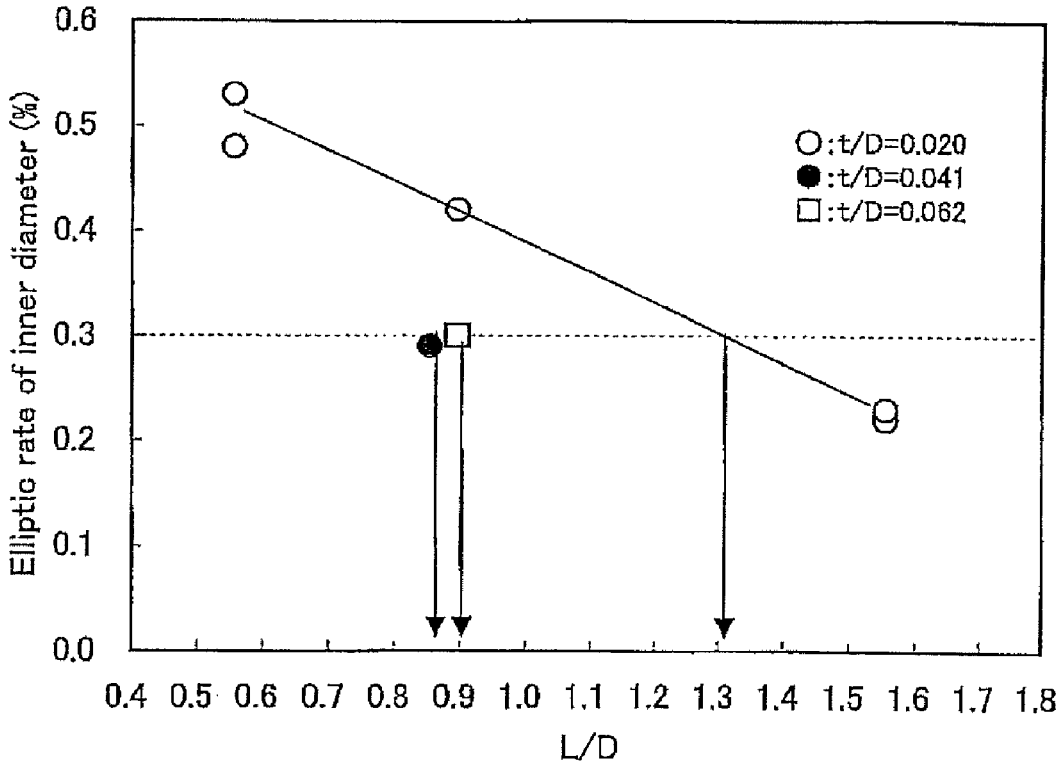
FIG. 6 is a drawing that shows the relationship between the elliptic rate of inner diameter and L/D in an embodiment.
Figure 7:
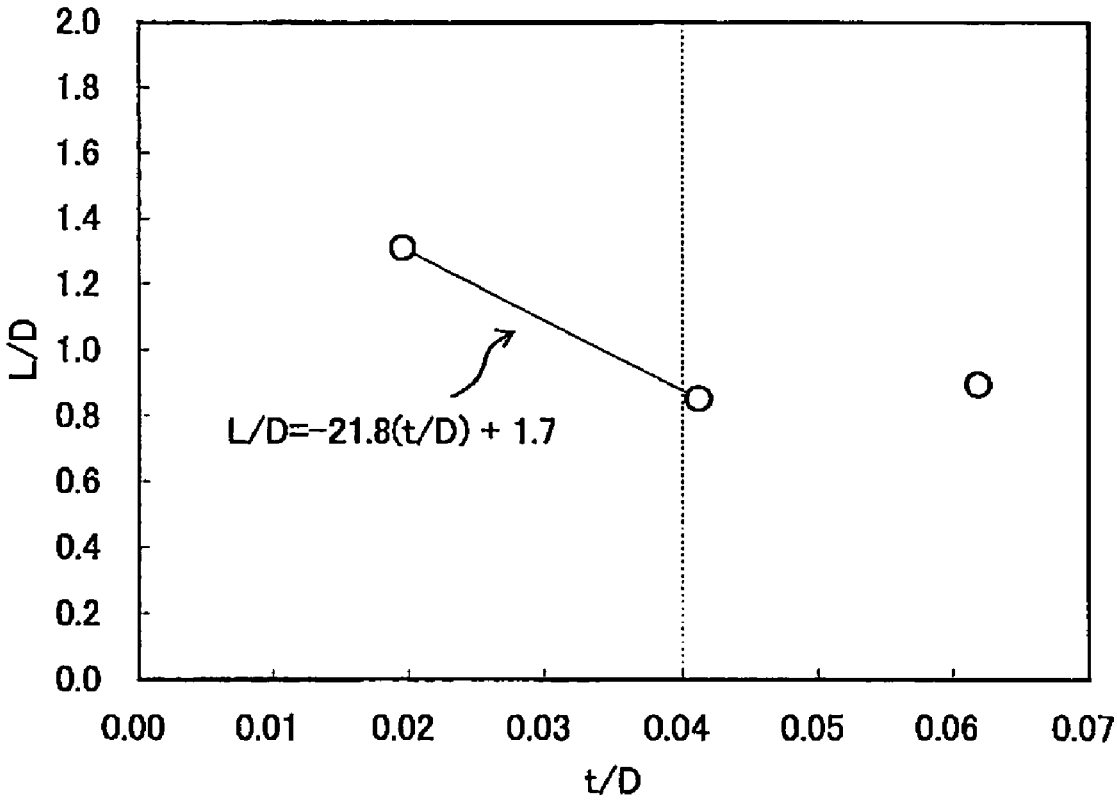
FIG. 7 is a drawing that shows the relationship between L/D and t/D at the time when the elliptic rate of inner diameter becomes 0.3% in the embodiment.

1. Pipe
2. Chuck
3. Plug (31. Taper portion, 32. Diameter equivalent portion)
4. Cylinder
5. Plug used for a conventional method (51. Taper portion, 52. Diameter equivalent portion)

The invention claimed is:

1. An apparatus for sizing a pipe end of a pipe comprising:

a plug for sizing the pipe end;

a chuck for clamping the pipe; and shifting means for shifting a position of the plug and/or the chuck, characterized by the plug has a circular cross section, and is constituted by a taper portion and a diameter equivalent portion continuously formed from a tip of the plug in succession, an outer diameter of the taper portion gradually expands from the tip toward a rear end while satisfying the following formulas (1) and (2) and the chuck is capable of changing a clamping position of the pipe:

$$22 \leqq LR/(D1 \times 0.01/2) \leqq 115 \quad (1)$$

$$R2 \geqq R1 \quad (2)$$

where meanings of respective symbols in the formulas are shown below:

D1: an outer diameter of the rear end of the taper portion, which also corresponds to an outer diameter (mm) of the diameter equivalent portion, LR: a distance (mm) in an axial direction from the rear end of the taper portion to a position at which the outer diameter of the taper portion is represented by D1×0.99, R1: a taper angle (°) at the rear end of the taper portion, and R2: a taper angle (°) at the position in which the outer diameter of the taper portion is represented by D1×0.99.

2. A method for sizing a pipe end of a pipe by using a plug, characterized by:

using the plug having a circular cross section and being constituted by a taper portion and a diameter equivalent portion continuously formed from a tip of the plug in succession;

an outer diameter of the taper portion gradually expands from the tip toward a rear end while satisfying the following formulas (1) and (2); and setting a clamping position of the pipe by a chuck in accordance with a value of a ratio (t/D) of a thickness t and an outer diameter D of the pipe:

$$22 \leqq LR/(D1 \times 0.01/2) \leqq 115 \quad (1)$$

$$R2 \geqq R1 \quad (2)$$

where meanings of respective symbols in the formulas are shown below:

D1: an outer diameter of the rear end of the taper portion, which also corresponds to an outer diameter (mm) of the diameter equivalent portion, LR: a distance (mm) in an the axial direction from the rear end of the taper portion to a position at which an outer diameter of the taper portion is represented by D1×0.99, R1: a taper angle (°) at the rear end of the taper portion, and R2: the taper angle (°) at the position in which the outer diameter of the taper portion is represented by D1×0.99.

3. The method for sizing the pipe end according to claim 2 characterized by, the pipe is clamped at a position in which the following formula is satisfied, when the ratio (t/D) of the thickness t and the outer diameter D of the pipe is 0.04 or less:

$$L/D>-21.8\times(t/D)+1.7 \quad (3)$$

where meanings of respective symbols in the formula are shown below:

t: Thickness of element pipe (mm),

D: Outer diameter of element pipe (mm), and

L: Distance from the pipe end of the pipe on a side from which the plug is inserted to the clamped position by the chuck (mm).

* * * * *